US006584902B2

(12) United States Patent
Shibuya et al.

(10) Patent No.: US 6,584,902 B2
(45) Date of Patent: Jul. 1, 2003

(54) INKING ROLLER NIP WIDTH ADJUSTMENTS IN A ROTARY PRINTING PRESS

(75) Inventors: Yasuo Shibuya, Tokyo (JP); Takeo Nanba, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 8 days.

(21) Appl. No.: 10/059,246

(22) Filed: Jan. 31, 2002

(65) Prior Publication Data

US 2002/0121201 A1 Sep. 5, 2002

(30) Foreign Application Priority Data

Mar. 2, 2001 (JP) ..... 2001-058050

(51) Int. Cl.[7] ..... B41F 7/40; B41F 31/30

(52) U.S. Cl. ..... 101/352.01; 101/148; 101/352.04; 101/352.05

(58) Field of Search ..... 101/148, 247, 101/351.1, 351.3, 351.4, 352.01, 352.04, 352.05, 352.09

(56) References Cited

U.S. PATENT DOCUMENTS 2,751,843 A * 6/1956 Faeber ..... 101/352.08
4,524,690 A * 6/1985 Omori ..... 101/148
4,625,642 A * 12/1986 Despot et al. ..... 101/352.04
4,711,174 A * 12/1987 Beisel ..... 101/352.04
4,741,269 A * 5/1988 Aylor et al. ..... 101/351.1
4,841,855 A * 6/1989 Marcum ..... 101/148
5,119,727 A * 6/1992 Miyamoto et al. ..... 101/352.05
5,142,977 A * 9/1992 Gertsch et al. ..... 101/148
5,230,284 A * 7/1993 Kelm ..... 101/352.04
5,819,656 A * 10/1998 Gertsch et al. ..... 101/352.09
6,058,837 A * 5/2000 Kamoda ..... 101/352.04
6,109,181 A * 8/2000 Kamoda ..... 101/351.3

FOREIGN PATENT DOCUMENTS

JP 33-3265 4/1958
JP 39-5720 4/1964

* cited by examiner

*Primary Examiner*—Stephen R. Funk
(74) *Attorney, Agent, or Firm*—Rader, Fishman & Grauer PLLC

(57) ABSTRACT

A rotary printing press has one or two inking rollers each in rolling engagement with both an ink supply cylinder and a plate cylinder. Each inking roller is identically supported by a first pair of roller support members mounted one adjacent each end of the ink supply cylinder for pivotal motion about the axis of that cylinder, and a second pair of roller support members mounted to the first pair for pivotal motion about an axis parallel to the axis of the ink supply cylinder, the second pair of roller support members rotatably supporting one inking roller therebetween. Adjusting screws act between the two pairs of roller support members for adjustably varying the nip width between the ink supply cylinder and each inking roller. The axis of each inking roller, and the axis of the pivotal motion of the second pair of roller support members relative to the first, are both so positioned that the width of the nip between the ink supply cylinder and each inking roller is adjustably variable without substantially varying the nip width between the inking roller and the plate cylinder.

9 Claims, 7 Drawing Sheets

INKING ROLLER NIP WIDTH ADJUSTMENTS IN A ROTARY PRINTING PRESS

BACKGROUND OF THE INVENTION

1. Field of the Invention

This invention relates to a rotary printing press having an inking roller or rollers in rolling engagement with both an ink supply cylinder and a plate cylinder for transferring the ink from the former to the latter. More specifically, the invention pertains to means in such a machine for adjustment of the widths of the nips between the ink supply cylinder and the inking roller or rollers and between the inking roller or rollers and the plate cylinder. The present invention is, however, equally well applicable to a lithographic press, for adjustment of the nip widths of a plate-moistening roller with respect to both a water supply cylinder and a plate cylinder.

2. Description of the Related Art

In rotary printing presses of the type under consideration, the inking roller or rollers are held under pressure against both ink supply cylinder and plate cylinder for positive ink transfer from the former to the latter. The printing ink is conveyed from an ink fountain to the ink supply cylinder via a succession of rollers, while being thereby spread into a thinner, more uniformly thick film, and thence, via the inking roller or rollers of somewhat reduced diameter, onto the printing plate on the plate cylinder. For uniformly inking the printing plate to a required degree, it is essential that the inking roller or rollers be pressed against the ink supply cylinder and the plate cylinder under pressures finely adjusted to provide nips of required widths therebetween.

Out of various suggestions heretofore made for such nip width adjustment, Japanese Patent Publication Nos. 33-3265 and 39-5270 are hereby cited as the prior art closest to the instant invention. According to the former, an inking roller is supported by and between a first pair of swing arms for pivotal motion therewith into and out of rolling engagement with an ink supply cylinder. A second pair of swing arms are coupled to the first pair for moving the inking roller into and out of rolling engagement with the plate cylinder. A dual cam mechanism is provided for independently actuating the two pairs of swing arms, in cooperation with springs biasing the second pair of swing arms toward the plate cylinder.

Upon actuation of the dual cam mechanism so as to increase the width of the nip between inking roller and plate cylinder, for instance, the second pair of swing arms turn in the required direction under the bias of the springs. With such turn of the second pair of swing arms, the first pair of swing arms wholly travel arcuately toward the plate cylinder about the axis of the second pair. At this time, as an inevitable result of the very construction of the dual cam mechanism, the axis of the inking roller is somewhat displaced away from the axis of the ink supply cylinder. Slight as it may be, this displacement of the inking roller axis manifested itself as an unintended change in the nip width between it and the ink supply cylinder.

Another difficulty of this prior art device arose from the fact that the first pair of swing arms have their axis positioned close to the surface of the plate cylinder, so far away from its axis. Consequently, upon actuation of the dual cam mechanism for adjustment of the nip width between inking roller and ink supply cylinder, another unintended change in the nip width occurred with the travel of the inking roller toward and away from the ink supply cylinder.

The adjustment of the nip widths under consideration constitutes an important task of creating an ink film of appropriate, unvarying thickness on the printing plate and so of producing printings of desired constant ink density. The finer and more exact the adjustment, the better will be the quality of the printings. According to the first recited prior art device, however, an adjustment of one nip width affected the other. Optimal adjustment of both nip widths was therefore an extremely difficult job, to be performed only by the most skilled workers. It was equally difficult to maintain proper ink density.

An additional inconvenience resulted from the fact that the inking roller is pressed against the plate cylinder by the force of compression springs acting on the second pair of swing arms. The nip pressure between inking roller and plate cylinder was subject to change, as under the influence of the dynamic balance of the inking roller, particularly during high speed printing. Variations in the nip width could result in changes in ink density on the printing plate and hence in deterioration of the printing quality. Furthermore, the complete prior art device for nip width adjustment was unnecessarily complex and expensive in construction and difficult of manipulation.

The second cited reference, Japanese Patent Publication No. 39-5720, is such that, both interposed between ink supply cylinder and plate cylinder, two inking rollers first have their nip widths with the ink supply cylinder adjusted by angular displacement of eccentric members on sleeves coaxial with the ink supply cylinder. Then the inking rollers have their nip widths with the plate cylinder adjusted without affecting the preadjusted nip widths with the ink supply cylinder, one of the inking rollers by causing, by means of worm gearing, the pivotal motion of a first pair of swing arms supporting the inking roller. The other inking roller is adjusted by turnbuckles capable of acting on a second pair of swing arms supporting the roller.

An objection to this second citation is that the nips are adjustable to required widths only when the nip widths are adjusted in the order of those between inking rollers and ink supply cylinder and then those between inking rollers and plate cylinder. It was totally impossible to adjust only the nip widths between inking rollers and ink supply cylinder without affecting those between inking rollers and plate cylinder. Nip width adjustment during the progress of printing was nearly impossible, either. The control of the ink density was therefore very difficult, and there was a high likelihood of deterioration in printing quality. In terms of mechanical construction, too, this prior art device was just as complex, expensive, and difficult of manipulation as the first described prior art.

SUMMARY OF THE INVENTION

The present invention has it as an object to make adjustably variable the width of the nip between an inking roller, or each of two inking rollers, and an ink supply cylinder without affecting the width of the nip between that inking roller and a plate cylinder, thereby making possible the fine readjustment of the rate of ink transfer to the plate cylinder.

Another object of the invention is to make such nip width adjustment possible not only when the printing press is out of operation but when it is printing, too, in order to maintain a high printing quality and to reduce downtime.

A further object of the invention is to make simpler, less expensive, and more easily operable than heretofore the construction of the means for such nip width adjustment.

A still further object of the invention is to make such nip with adjustment possible either manually or by power, and, in the case of power-driven adjustment, either remotely or by direct pushbutton control.

Briefly, and speaking generically, the present invention may be summarized as a rotary printing press having a liquid form roller for receiving a liquid from a liquid supply cylinder and applying the liquid to a plate cylinder. The invention provides, in combination with such means, a first pair of roller support members mounted one adjacent each end of the liquid supply cylinder for angular displacement relative to the same about the axis of the liquid supply cylinder. A second pair of roller support members are mounted respectively to the first pair of roller support members for pivotal motion relative to the same about an axis parallel to the axis of the liquid supply cylinder, the second pair of roller support members rotatably supporting therebetween the liquid form roller for rolling contact with both the liquid supply cylinder and the plate cylinder. Also provided are adjustment means (e.g. adjusting screws) acting between the first and the second pair of roller support members for adjustably causing the pivotal motion of the second pair of roller support members relative to the first pair of roller support members and hence for adjustably varying the width of the nip between the liquid supply cylinder and the liquid form roller.

There are the following positional relationship among the members set forth above: The liquid form roller when in rolling contact with both the liquid supply cylinder and the plate cylinder has its axis substantially contained in a plane containing both the axis of the pivotal motion of the second pair of roller support members relative to the first pair of roller support members and the axis of the plate cylinder. Further the axis of the pivotal motion of the second pair of roller support members relative to the first pair of roller support members is substantially contained in a plane tangent to both the liquid supply cylinder and the liquid form roller at the nip therebetween. Consequently, the width of the nip between the liquid supply cylinder and the liquid form roller is adjustably variable by the adjustment means without substantially varying the width of the nip between the liquid form roller and the plate cylinder.

The foregoing summary contains some generic terms in consideration of the fact that the present invention is applicable to both inking and moistening mechanisms. The word "liquid" may therefore mean either ink or water. Further, in the preferred embodiments to be disclosed subsequently, in which the invention is applied to the inking mechanism, the "liquid form roller" will be referred to as inking roller, and the "liquid supply cylinder" as ink supply cylinder.

As set forth in the summary above, the nip width between the ink supply cylinder and the inking roller is adjustably variable without substantially varying the nip width between the inking roller and the plate cylinder. The rate of ink transfer from the ink supply cylinder to the plate cylinder is therefore finely readjustable by adjusting screws or the like. Such readjustment is possible during the progress of printing, in order to recover and maintain an optimum ink density on the web.

The adjusting screws may be turned either manually, as in one embodiment, or by power, as in another. The power driving of the adjusting screws, preferably under remote control, is recommended not only for the ease and quickness of readjustment during printing but for the safety of the operator, too.

Both embodiments to be disclosed employ two inking rollers, rather than one, each in rolling engagement with both ink supply cylinder and plate cylinder. Each inking roller is supported essentially alike, and provided with like adjustment means, so that the nip width between each inking roller and the ink supply cylinder is adjustably variable without substantially affecting the nip width between that inking roller and the plate cylinder. Still finer readjustment of ink density is possible in this manner.

Each inking roller requires a minimal number of parts for nip width adjustment with both ink supply cylinder and plate cylinder. All such parts can be compactly mounted within the framework of the press, without making the same any larger than heretofore.

The above and other objects, features and advantages of this invention will become more apparent, and the invention itself will best be understood, from a study of the following description and appended claims, with reference had to the attached drawings showing the preferred embodiments of the invention.

DESCRIPTION OF THE PREFERRED EMBODIMENTS

General

The invention will now be described in detail as applied specifically to an inking mechanism in a printing station of a rotary press for newspaper production. It is understood that the inking mechanism is keyless; that is, there are no density control keys provided in the ink fountain. In the preferred embodiments of the invention shown in the above drawings, two inking rollers of different diameters are provided for adjustable-rate ink transfer from an ink supply cylinder to a plate cylinder. The width of the nip between each inking roller and the ink supply cylinder, and that of the nip between each inking roller and the plate cylinder, are individually adjustable for a desired rate of ink transfer to the plate cylinder and therefore for a desired ink density of the printings made. Furthermore, according to the invention, the nip widths between the two inking rollers and the ink supply cylinder are individually adjustable without substantially affecting those between the inking rollers and the plate cylinder, for fine readjustment of the rate of ink transfer to the plate cylinder.

In the first preferred embodiment, shown in FIGS. 1–6 of the drawings, the two inking rollers 1 and 2 are provided with different means for adjustment of their nip widths with respect to the ink supply cylinder 3 and the plate cylinder P. Such nip width adjustment means for the two inking rollers 1 and 2 are situated so close together that it is considered easier of understanding if the inking rollers are shown separately together with the adjustment means associated therewith.

Figure 1:
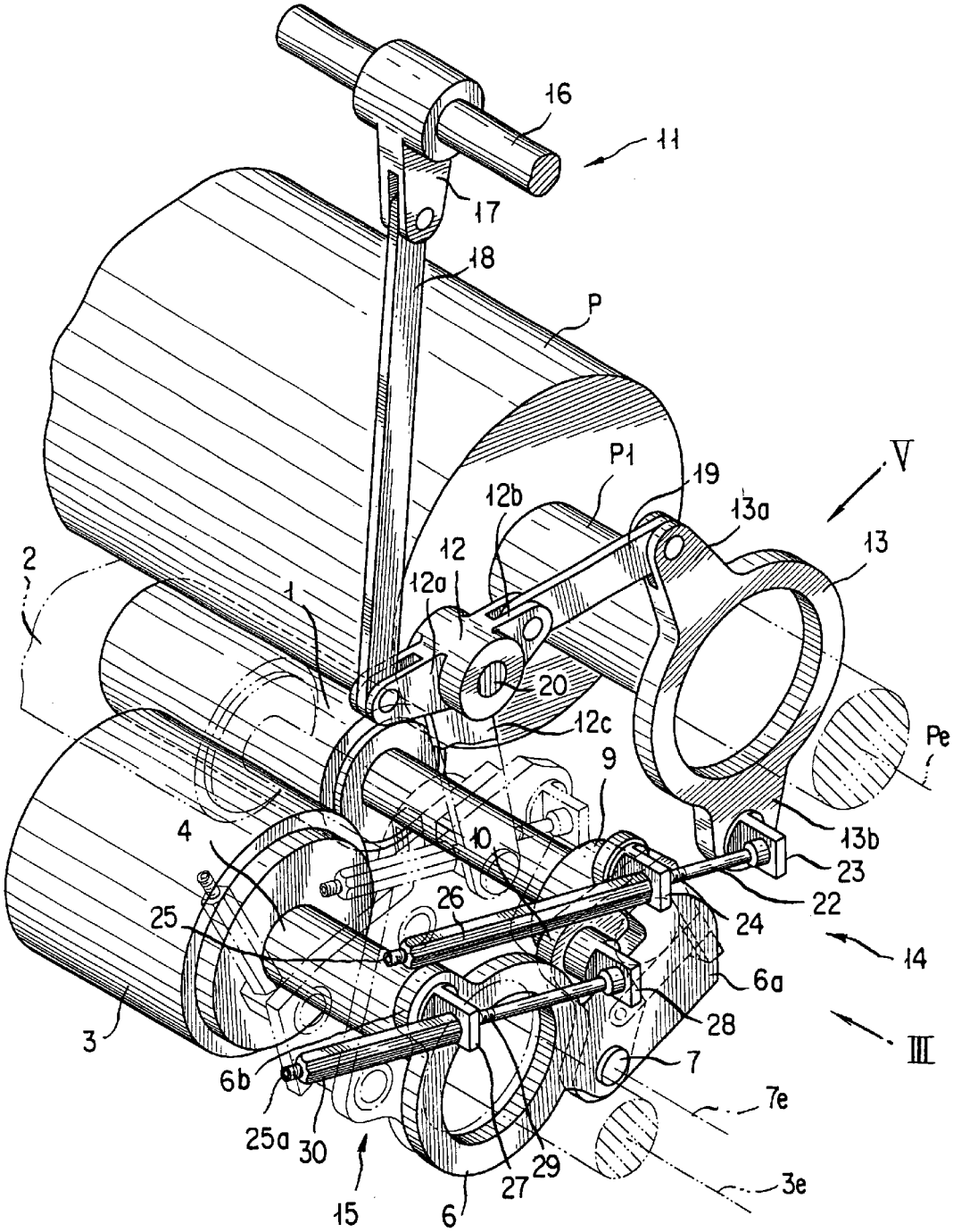
FIG. 1 is a fragmentary perspective view showing the ink supply cylinder, two inking rollers, and plate cylinder of a rotary printing press for newspaper production, the first of the inking rollers being shown by solid lines together with means for adjustment of its nip widths with respect to the ink supply cylinder and the plate cylinder, the second inking roller and means for its nip width adjustment being indicated by broken lines.
Figure 2:
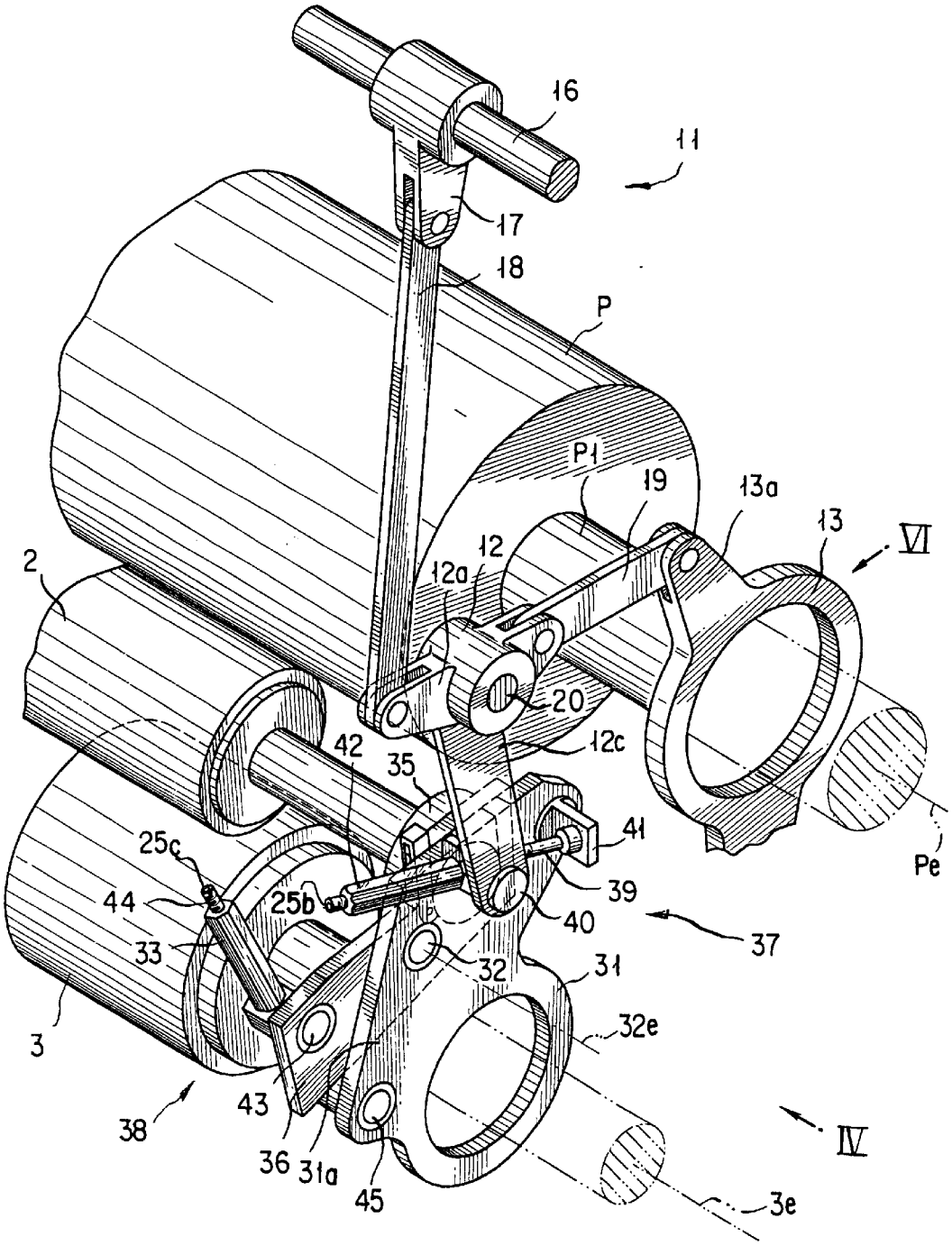
FIG. 2 is a view similar to FIG. 1 except that the first inking roller and the means for adjustment of its nip widths are not shown in order to clearly reveal the second inking roller and the means for adjustment of its nip widths.
Figure 3:
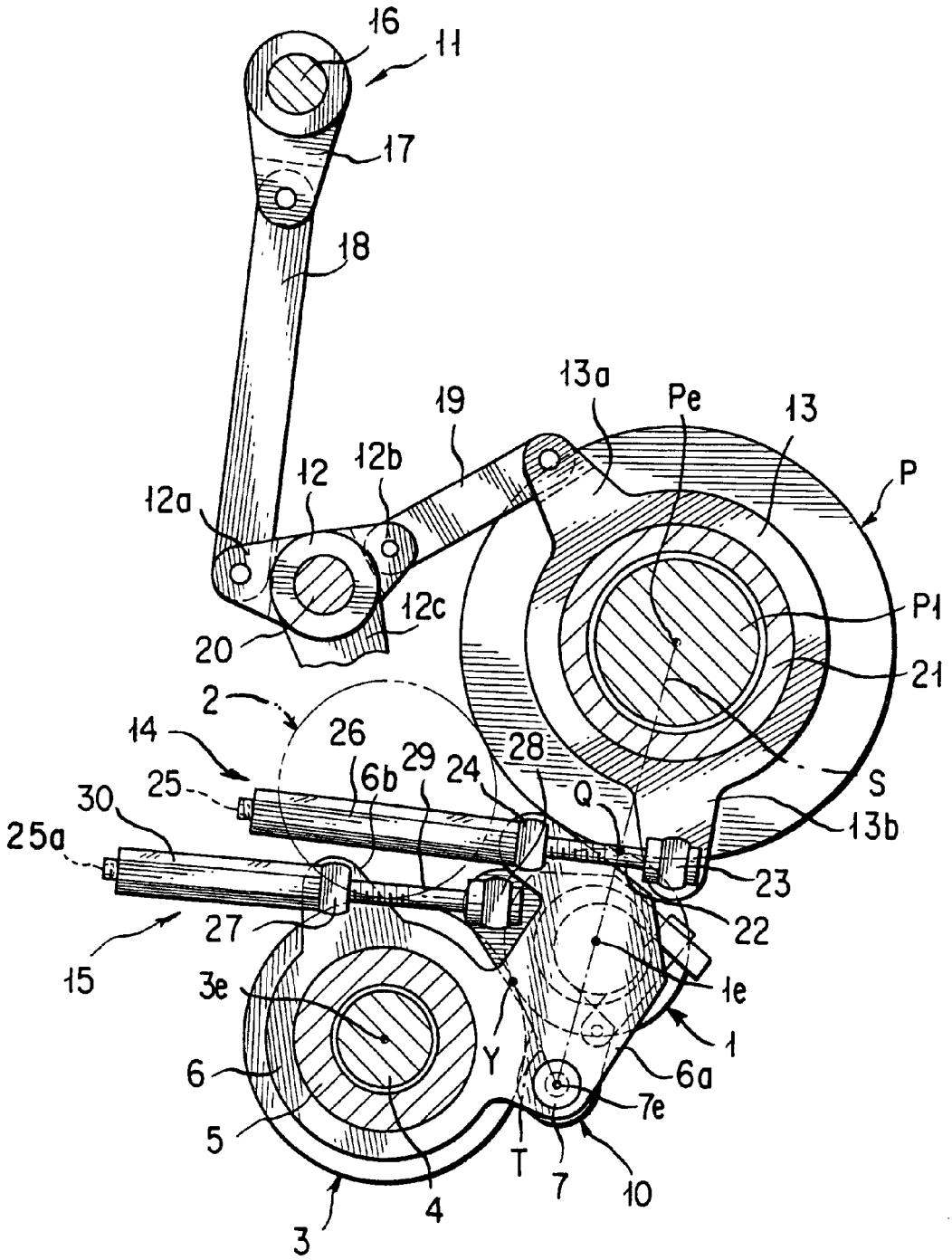
FIG. 3 is an end elevational view, partly in section, of the showing of FIG. 1 as seen in the direction of the arrow III therein, the view showing the first inking roller, as well as the nip width adjustment means therefor, by solid lines, and the second inking roller by broken lines.
Figure 4:
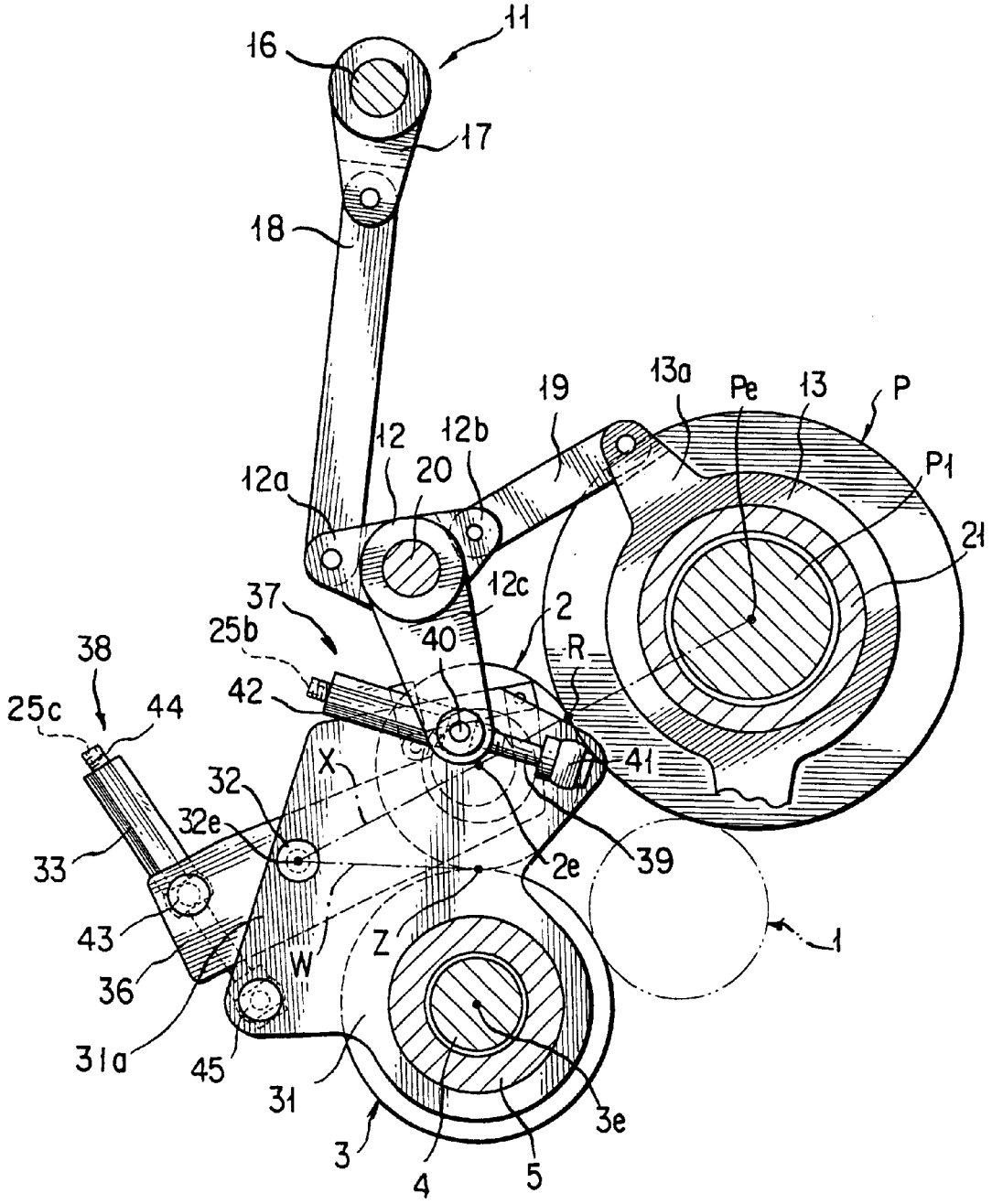
FIG. 4 is an end elevational view, partly in section, of the showing of FIG. 2 as seen in the direction of the arrow IV therein, the view showing the second inking roller, as well as the nip width adjustment means therefore, by solid lines, and the first inking roller by broken lines.
Figure 5:
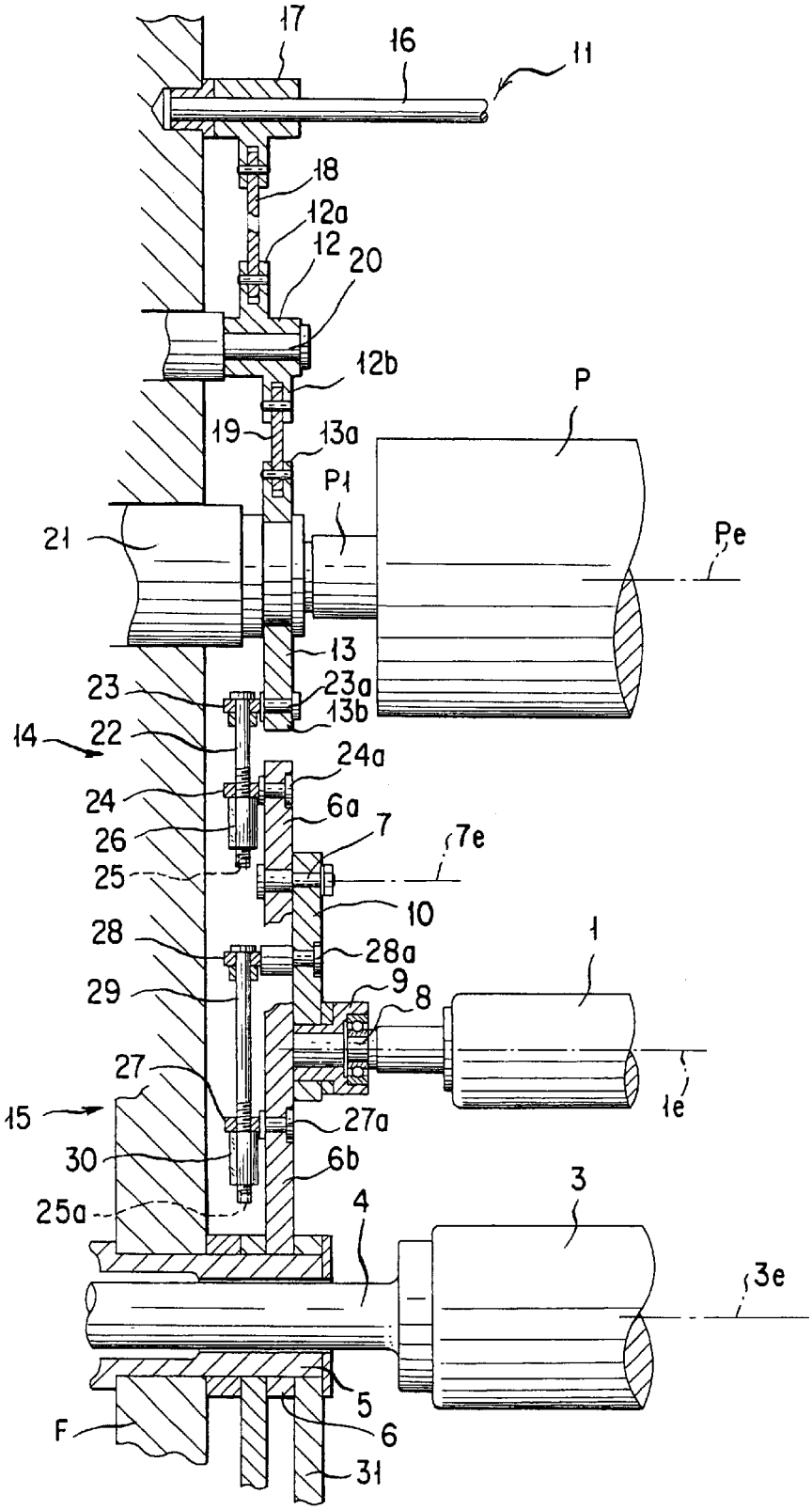
FIG. 5 is a developed view, partly in section and partly in elevation, of the showing of FIG. 1 as seen in the direction of the arrow V therein, the view showing in particular the nip width adjustment means for the first inking roller and not showing the second inking roller.
Figure 6:
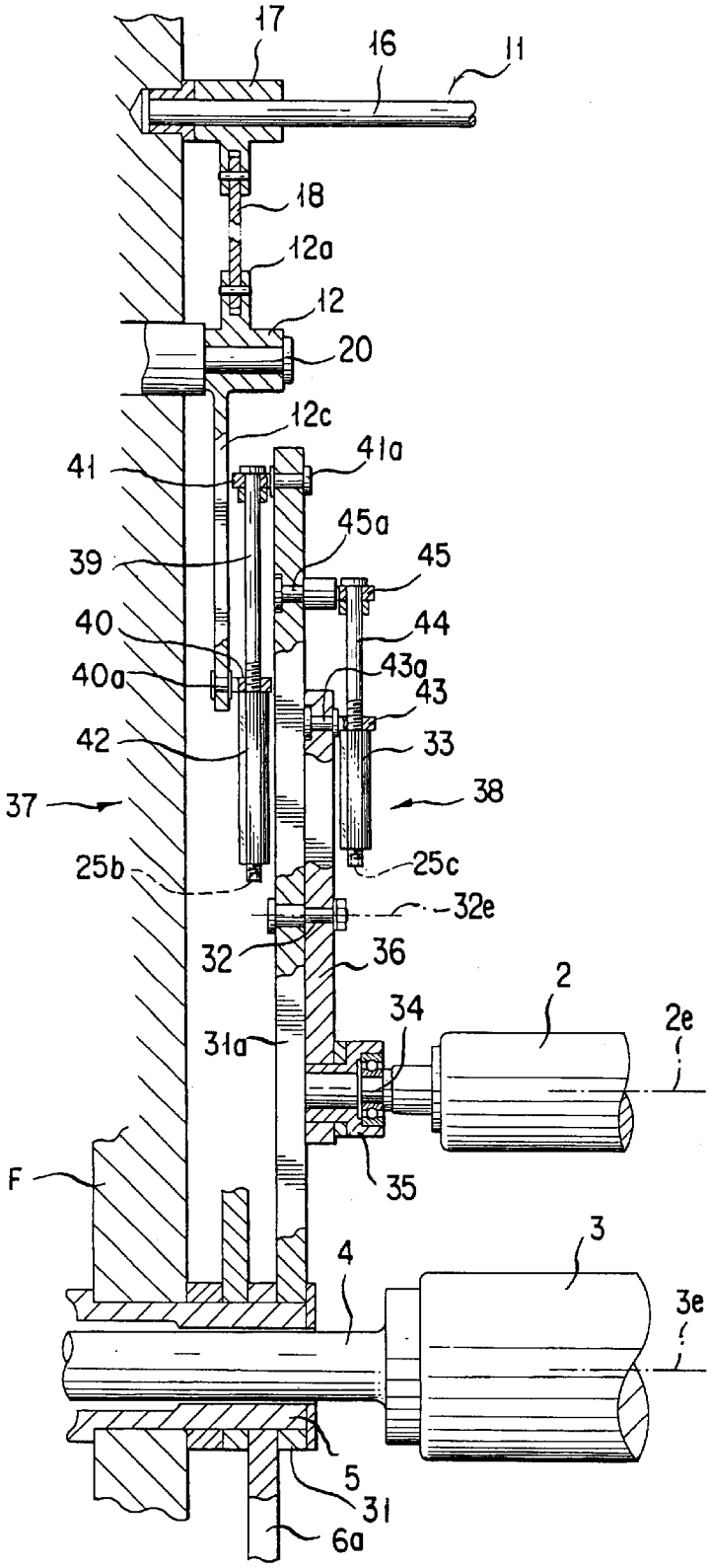
FIG. 6 is a developed view, partly in section and partly in elevation, of the showing of FIG. 2 as seen in the direction of the arrow VI therein, the view showing in particular the nip width adjustment means for the second inking roller and not showing the first inking roller and the plate cylinder.

In FIGS. 1, 3 and 5, therefore, only the first inking roller 1 is shown together with its nip width adjustment means with respect to both the ink supply cylinder 3 and the plate cylinder P. The second inking roller 2 as well as its nip width adjustment means is outlined by broken lines in FIG. 1, although the second inking roller itself is indicated in phantom outline in FIG. 3, too, in order to indicate its positional relationship to other members. FIGS. 2, 4 and 6, on the other hand, show the second inking roller 2 together with its nip width adjustment means with respect to both the ink supply cylinder 3 and the plate cylinder P. The first inking roller 1 is shown in phantom outline in FIG. 4.

While both inking rollers 1 and 2 might be held in constant rolling engagement with the ink supply cylinder 3, they should desirably be made movable into and out of rolling engagement with the plate cylinder P, in order that ink transfer to the plate cylinder may be instantly discontinued, and instantly restarted, as required. Provided to this end are inking start/stop means 11, seen in all of FIGS. 1–6, which are coupled to the nip width adjustment means for both inking rollers 1 and 2 in order to jointly move these rollers into and out of rolling engagement with the plate cylinder P.

Hereinafter in this specification the noted inking start/stop means 11 and the nip width adjustment means for the inking rollers 1 and 2 will be explained in more detail under separate headings. The nip width adjustment means and the inking start/stop means are provided symmetrically at and adjacent the opposite ends of the illustrated rollers and cylinders, and inwardly of a pair of confronting framing walls, one shown at F in FIGS. 5 and 6, of the press. Only the means adjacent one end of each roller or cylinder will be detailed, it being understood that the same detailed description applies to the other means adjacent the other end of each roller or cylinder.

Inking Start/Stop Means

As shown in FIG. 1 for instance, the inking start/stop means 11 include a shaft 16 extending parallel to the axis of the plate cylinder P and having its opposite ends rotatably journaled in bearing means in the pair of framing walls F as in FIGS. 5 and 6. The rotary shaft 16 has nonrotatably mounted thereon a lug 17 to which a link 18 is pin-jointed at one end. The other end of the link 18 is likewise pin-jointed to one, 12*a*, of three lugs 12*a*, 12*b* and 12*c* extending radially from a sleeve 12 rotatably mounted on a fixed pin 20. The second lug 12*b* on the sleeve 12 is pinned to one end of another link 19, which has its other end pinned to one, 13*a*, of two lugs 13*a* and 13*b* formed radially on a collar or ring 13. This ring 13 is rotatably fitted over a sleeve 21 which is mounted to the framing wall F and which coaxially surrounds the trunnion $P_1$ of the plate cylinder P, so that the lugs 13*a* and 13*b* on the ring 13 are pivotable about the axis $P_e$ of the plate cylinder.

It is thus seen that the bidirectional rotation of the shaft 16 results in that of the sleeve 12 and hence in that of the collar 13. The third lug 12*c* of the sleeve 12 is coupled to the nip width adjustment means for the second inking roller 2, and the second lug 13*b* of the collar 13 to the nip width adjustment means for the first inking roller 1.

Nip Width Adjustment Means for the First Inking Roller

A reference to all of FIGS. 1, 3 and 5 will redound to a better understanding of the nip width adjustment means for the first inking roller 1. Such adjustment means include:

1. A ring or collar 6 rotatably mounted on a sleeve 5, FIG. 5, which concentrically surrounds the trunnion 4 of the ink supply cylinder 3 and which is immovably mounted to the framing wall F.
2. A first inking roller carrier 10 which is pivoted at 7 to a first lug 6*a* extending radially from the ring 6, for pivotal motion about an axis 7*e* parallel to the first inking roller axis 1*e* and ink supply cylinder axis 3*e*, and which rotatably supports the first inking roller trunnion 8 via an eccentric bearing 9.
3. First manual adjustment means 14 operatively connected between the second lug 13*b* of the ring 13 of the inking start/stop means 11 and the first lug 6*a* of the ring 6 for manual adjustment of the nip width between first inking roller 1 and plate cylinder P.
4. Second manual adjustment means 15 operatively connected between a second lug 6*b* extending radially from the ring 6 and the first inking roller carrier 10 for manual adjustment of the nip width between first inking roller 1 and ink supply cylinder 3.

Perhaps as best seen in FIG. 5, the first manual adjustment means 14 include an adjusting screw 22 having its headed end rotatably received in a ring 23 having a mounting pin 23*a* which extends radially therefrom and which is rotatably coupled to the lug 13*b* of the ring 13 of the inking start/stop means 11. The adjusting screw 22 is therefore coupled to the lug 13*b* for pivotal motion in a plane at right angles with the plate cylinder axis $P_e$. Although rotatable about its own axis relative to the ring 23, the adjusting screw 22 is locked against longitudinal displacement in either direction relative to the ring 23.

Operatively coupled to the ring 13 of the inking start/stop means 11 as above, the adjusting screw 22 extends through a nut 24 in threaded engagement therewith. This nut 24 is also provided with a mounting pin 24*a* extending radially therefrom and rotatably coupled to the lug 6*a* of the ring 6 around the ink supply cylinder trunnion 4. The adjusting screw 22 is capable of angular displacement relative to the lug 6*a* via the mounting pin 24*a* in a plane at right angles with the plate cylinder axis $P_e$, besides being so angularly displaceable relative to the lug 13*b*. Projecting from the nut 24, the adjusting screw 22 terminates in a hexagon socket 25 for use in manually turning the screw for adjustment of its length between the ring 23 and the nut 24. A locknut 26 is fitted over the threaded end portion of the adjusting screw 22 for positively holding its portion between ring 23 and nut 24 at any adjusted length.

With particular reference to FIG. 3 the axis 1*e* of the first inking roller 1 is approximately contained in a plane S containing the axis 7*e* of the pivot pin 7, about which the first inking roller turns relative to the lug 6*a*, and the axis $P_e$ of the plate cylinder P. A reference nip width between first inking roller 1 and ink supply cylinder 3 is determinable by manipulation of the second manual adjustment means 15, yet to be detailed, and by adjustment of the angular position of the eccentric bearing 9 supporting the first inking roller. Then, upon manipulation of the adjusting screw 22 of the first manual adjustment means 14 to set its portion between ring 23 and nut 24 at a prescribed length, the first inking roller 1 will travel along the circumference of the ink supply cylinder 3 without changing the nip width therebetween and come to establish a reference nip width between first inking roller 1 and plate cylinder P. Thereupon, as stated above, the axis 1*e* of the first inking roller 1 will be either contained in, or very close to, the plane S.

Following such preliminary adjustments, with the consequent establishment of the reference nip widths of the first inking roller 1, the adjusting screws 22 and 29 of both manual adjustment means 14 and 15 may again be turned as required for fine readjustment of the nip widths of the first inking roller 1 with respect to the ink supply cylinder 3 and plate cylinder P. Such fine readjustment is possible regardless of whether the press is in or out of operation.

Reference may also be had mostly to FIG. 5 for a study of the second manual adjustment means 15. The adjusting screw 29, a primary member of the second manual adjustment means 15, extends through a nut 27 in threaded engagement therewith and further rotatably through a ring 28. The nut 27 has a mounting pin 27*a* extending radially therefrom and rotatably coupled to the second lug 6*b* of the ring 6 around the ink supply cylinder trunnion 4. Therefore, although not rotatable about its own axis relative to the lug 6*b*, the nut 27 is angularly displaceable about an axis parallel to the ink supply cylinder axis 3*e*. The ring 28 also has a mounting pin 28*a* extending radially therefrom and rotatably coupled to the first inking roller carrier 10, so that, although also nonrotatable about its own axis relative to the first inking roller carrier 10, the ring 28 is rotatable about an axis parallel to the first inking roller axis 1*e*. The adjusting screw 29 is locked against displacement in either longitudinal direction relative to the ring 28. A hexagon socket 25*a* is formed in the threaded end of the adjusting screw 29 for use in turning the same. A locknut 30 is fitted over the threaded end of the adjusting screw 29.

With reference to FIG. 3 again, when the axis 1*e* of the first inking roller 1 is approximately contained in the plane S containing the axis 7*e* of the pivot pin 7, about which the first inking roller turns relative to the lug 6*a*, and the axis $P_e$ of the plate cylinder P, the pivot pin axis 7*e* is substantially contained in a plane T that is tangent to both first inking roller 1 and ink supply cylinder 3 at the nip, or centerline of the nip, Y therebetween. By the modifier "substantially" is meant either that the pivot pin axis 7*e* is contained in the plane T, or that a plane containing the pivot pin axis 7*e* and the nip centerline Y is at an angle of not more than approximately fifteen degrees from the plane T on either side thereof.

With the pivot pin axis 7*e* substantially contained as above in the plane T, the nip centerline Y will travel along a path approximately at right angles with the plane T. Consequently, with the slightest angular displacement of the first inking roller carrier 10, the first inking roller 1 will undergo relatively great displacement toward the ink supply cylinder axis 3*e*. The nip width between first inking roller 1 and ink supply cylinder 3 will therefore vary greatly with a slight angular motion of the first inking roller.

Such slight displacement of the first inking roller 1, needed for nip width adjustment with the ink supply cylinder 3, will hardly affect its nip width with the plate cylinder P. This is because the displacement of the first inking roller 1 due to the angular motion of the first inking roller carrier 10 will occur approximately at right angles with the plane S containing the plate cylinder axis $P_e$ and pivot pin axis 7*e*, that is, along a plane tangent to both plate cylinder P and first inking roller 1 at the nip Q therebetween. Upon completion of the necessary adjustments the locknut 26 of the first manual adjustment means 14 and the locknut 30 of the second manual adjustment means 15 may be both retightened to positively maintain the desired nip widths.

Nip With Adjustment Means for the Second Inking Roller

Reference may be had to FIGS. 2, 4 and 6 for a consideration of the nip width adjustment means for the second inking roller 2. Such adjustment means include:

1. A second ring or collar 31, complete with a lug 31*a*, rotatably mounted on the sleeve 5, FIG. 6, which concentrically surrounds the trunnion 4 of the ink supply cylinder 3 and which is immovably mounted to the framing wall F; the second ring 31 being contiguous to the first ring 6 set forth in conjunction with the nip width adjustment means for the first inking roller 1.
2. A second inking roller carrier 36 which is pivotally pinned at 32 to the lug 31*a* of the second ring 31 for pivotal motion about the pivot pin axis 32*e* parallel to the second inking roller axis 2*e* and ink supply cylinder axis 3*e*, and which rotatably supports the second inking roller trunnion 34, FIG. 6, via an eccentric bearing 35.
3. First manual adjustment means 37 operatively connected between the third lug 12*c* of the ring 12 of the inking start/stop means 11 and the lug 31*a* of the ring 31 for manual adjustment of the nip width between second inking roller 2 and plate cylinder P.
4. Second manual adjustment means 38 operatively connected between the lug 31*a* of the ring 31 and the second inking roller carrier 36 for manual adjustment of the nip width between second inking roller 2 and ink supply cylinder 3.

With reference to FIG. 6 in particular the first manual adjustment means 37 for the second inking roller 2 include an adjusting screw 39 having its headed end rotatably received in a ring 41 having a mounting pin 41*a* which extends radially therefrom and which is rotatably coupled to the lug 31*a* of the ring 31 around the ink supply cylinder trunnion 4. The adjusting screw 39 is therefore coupled to the lug 31*a* for pivotal motion in a plane at right angles with the ink supply cylinder axis 3*e*. Although rotatable about its own axis relative to the ring 41, the adjusting screw 39 is locked against longitudinal displacement in either direction relative to this ring 41.

Operatively coupled to the lug 31*a* as above, the adjusting screw 39 of the first manual adjustment means 37 extends through a nut 40 in threaded engagement therewith. This nut 40 is also provided with a mounting pin 40*a* extending radially therefrom and rotatably coupled to the third lug 12*c* of the ring 12 of the inking start/stop means 11. Thus the adjusting screw 39 is capable of angular displacement relative to the lug 12*c* via the mounting pin 40*a* in a plane at right angles with the plate cylinder axis $P_e$, besides being so displaceable relative to the lug 31*a*. Projecting from the nut 40, the adjusting screw 39 terminates in a hexagon socket 25*b* for use in manually turning the screw for adjustment of its length between nut 40 and ring 41. A locknut 42 is fitted over the threaded end portion of the adjusting screw 39 for positively holding its portion between nut 40 and ring 41 at any adjusted length.

With particular reference to FIG. 4 the axis 2*e* of the second inking roller 2 is approximately contained in a plane X containing the axis 32*e* of the pivot pin 32, about which the second inking roller turns relative to the lug 31*a*, and the axis $P_e$ of the plate cylinder P. A reference nip width between second inking roller 2 and ink supply cylinder 3 is determinable by manipulation of the second manual adjustment means 38, yet to be detailed, and by adjustment of the angular position of the eccentric bearing 35 supporting the second inking roller. Then, upon manipulation of the adjusting screw 39 of the first manual adjustment means 37 to set its portion between nut 40 and ring 41 at a prescribed length, the second inking roller 2 will travel along the circumference of the ink supply cylinder 3 without changing the nip width therebetween and come to establish a reference nip width between second inking roller 2 and plate cylinder P. Thereupon, as stated above, the axis 2*e* of the second inking roller 2 will be either contained in, or very close to, the plane X.

Following such preliminary adjustments, with the consequent establishment of the reference nip widths of the second inking roller 2 with respect to both ink supply cylinder 3 and plate cylinder P, the adjusting screws 39 and 44 of both manual adjustment means 37 and 38 may again be turned as required for fine readjustment of the nip widths of the second inking roller 2 with respect to the ink supply cylinder 3 and plate cylinder P. Such fine readjustment is possible regardless of whether the press is in or out of operation.

Reference may also be had mostly to FIG. 6 for a study of the second manual adjustment means 38. The adjusting screw 44, a primary member of the second manual adjustment means 38, extends through a nut 43 in threaded engagement therewith and further rotatably through a ring 45. The nut 43 has a mounting pin 43*a* extending radially therefrom and rotatably coupled to the second inking roller carrier 36. Therefore, although not rotatable about its own axis relative to the second inking roller carrier 36, the nut 43 is angularly displaceable relative to the same about an axis parallel to the second inking roller axis 2*e*. The ring 45 also has a mounting pin 45*a* extending radially therefrom and rotatably coupled to the lug 31*a* of the ring 31 around the ink supply cylinder trunnion 4, so that, although also nonrotatable about its own axis relative to the lug 31*a*, the ring 45 is rotatable relative to the same about an axis parallel to the second inking roller axis 2*e*. The adjusting screw 44 is locked against displacement in either longitudinal direction relative to the ring 45. A hexagon socket 25*c* is formed in the threaded end of the adjusting screw 44 for use in turning the same. A locknut 33 is fitted over the threaded end of the adjusting screw 44.

With reference to FIG. 4 again, when the axis 2*e* of the second inking roller 2 is approximately contained in the plane X containing the axis 32*e* of the pivot pin 32, about which the second inking roller turns relative to the lug 31*a*, and the axis $P_e$ of the plate cylinder P, the pivot pin axis 32*e* is substantially contained in a plane W that is tangent to both second inking roller 2 and ink supply cylinder 3 at the nip, or centerline of the nip, Z therebetween. By the modifier "substantially" is meant either that the pivot pin axis 32*e* is contained in the plane W, or that a plane containing the pivot pin axis 32*e* and the nip centerline Z is at an angle of not more than approximately fifteen degrees from the plane W on either side thereof.

With the pivot pin axis 32*e* substantially contained as above in the plane W, the nip centerline Z will travel along a path approximately at right angles with the plane W. Consequently, with the slightest angular displacement of the second inking roller carrier 36, the second inking roller 2 will undergo relatively great displacement toward the ink supply cylinder axis 3*e*. The nip width between second inking roller 2 and ink supply cylinder 3 will therefore vary greatly with a slight angular motion of the second inking roller.

Such slight displacement of the second inking roller 2, needed for nip width adjustment with the ink supply cylinder 3, will hardly affect its nip width with the plate cylinder P. This is because the displacement of the second inking roller 2 due to the angular motion of the second inking roller carrier 36 will occur approximately at right angles with the plane X containing the plate cylinder axis $P_e$ and pivot pin axis 32*e*, that is, along a plane tangent to both plate cylinder P and second inking roller 2 at the nip R therebetween. Upon completion of the necessary adjustments the locknut 42 of the first manual adjustment means 37 and the locknut 33 of the second manual adjustment means 38 may be both retightened to positively maintain the desired nip widths.

In rotary printing presses in general, the viscosity of the ink being supplied over series of rollers is bound to lower with the progress of printing, by reason of an inevitable rise in temperature. The rate of ink transfer from ink supply cylinder 3 to inking rollers 1 and 2 will therefore decrease with the drop in ink viscosity if the nip widths therebetween are held unchanged. Conversely, upon substantive decrease in printing speed, the resulting drop in temperature will cause an increase in ink viscosity and hence in the rate of ink transfer from ink supply cylinder 3 to inking rollers 1 and 2 will increase.

The ink path in the illustrated embodiment of the invention is such that, fed onto the ink supply cylinder 3 from the ink fountain, not shown, the ink is transferred therefrom onto the inking rollers 1 and 2 via the nips of adjusted widths therebetween and thence onto the surface of the printing plate on plate cylinder P. The ink must overlie the printing plate surface in a film of uniform, appropriate thickness. The nip widths between ink supply cylinder 3 and inking rollers 1 and 2 must be optimally adjusted and maintained toward that end. The thickness of the ink film on the printing plate surface depends upon the thicknesses of the ink films on the inking rollers 1 and 2.

Indeed, in multicolor, keyless inking mechanisms of rotary printing presses for newspaper production in particular, the ink supply cylinder 3 of the illustrated embodiment serves the purpose of ink metering. The rate of ink transfer to the supply cylinder 3 is designed to be constant, and so is that of ink transfer to the plate cylinder P via the inking rollers 1 and 2. Actually, however, the rate of ink transfer to the plate cylinder, and the resulting ink density of the printings being made, are subject to fluctuations depending upon such factors as the specific composition, and consequent physical properties (e.g. flow, viscosity, tack, transference), of the ink in use and the temperature of the rollers and cylinders. The behavior of the ink is particularly vulnerable to the surface temperature of the rollers and cylinders. Any such undesired change in ink density is eliminable through readjustment of the nip widths between the rollers and cylinders, especially of the nip width or widths between the ink supply cylinder 3 and either or both of the inking rollers 1 and 2, by the means set forth hereinbefore with reference to FIGS. 1–6.

The nip width between ink supply cylinder 3 and first inking roller 1, for instance, is readjustable as follows in order to rectify a change in ink density. With the locknut 30 of the second manual adjustment means 15, FIGS. 1, 3 and 5 loosened, the adjusting screw 29 may be turned in a tightening or loosening direction to increase or decrease the nip width between ink supply cylinder 3 and first inking roller 1. The nip width may be increased in the event of a drop in ink density, and vice versa, thereby increasing or decreasing the rate of ink transfer from ink supply cylinder 3 to first inking roller 1. Similarly, the nip width between ink supply cylinder 3 and second inking roller 2 is readjustable by the second manual adjustment means 38, FIGS. 2, 4 and 6, for the second inking roller. With the locknut 33 loosened, the adjusting screw 44 may be turned in either direction for increasing or decreasing the nip width between ink supply cylinder 3 and second inking roller 2.

Advantageously, the preset nip widths between the inking rollers 1 and 2 and the plate cylinder P remain practically unchanged despite such readjustment of the nip widths between the inking rollers and the ink supply cylinder 3. The following results were obtained from experiment conducted on a full-scale model constructed just like the FIGS. 1–6 embodiment.

The nip widths between the inking rollers 1 and 2 and the ink supply cylinder 3 were both preset at 8.000 millimeters, and so were the nip widths between the inking rollers and the plate cylinder P. Then the nip width between first inking roller 1 and ink supply cylinder 3 was readjusted to 3.000 millimeters by the manual adjustment means 15, and that between second inking roller 2 and ink supply cylinder to zero by the manual adjustment means 38. The resulting nip width between first inking roller 1 and plate cylinder P was 7.993 millimeters, and that between second inking roller 2 and plate cylinder also 7.993 millimeters. The accompanying reduction in nip widths between the two inking rollers and the plate cylinder was therefore both only 0.225 percent.

It is clear from the foregoing results of experimentation that the nip widths between inking rollers and plate cylinder are hardly, if any, affected by changes in nip width between inking rollers and ink supply cylinder. This means that the rate of ink transfer from inking rollers 1 and 2 to plate cylinder P is practically constant in the face of the readjustment of the rate of ink transfer from ink supply cylinder to inking rollers. The rate of ink transfer to the plate cylinder is therefore finely readjustable through manipulation of either or both of the adjusting screws 29 and 44 of the manual adjustment means 15 and 38.

The present applicant has also experimented on the effects of variations in the nip widths in question upon the ink density of the printings. The machine used for the experimentation was a multicolor press for newspaper production, with the viscosities of the yellow, red, and indigo blue inks all at approximately nine pascal-seconds, and that of the black ink at approximately six pascal-seconds. All the inks contained 15 percent of water in order to closely simulate actual printing.

The experiment was made at the single-sided delivery rate of sixty thousand signatures per hour. The nip widths between inking rollers 1 and 2 and plate cylinder P were set at eight millimeters and thereafter left untouched. The nip width between first inking roller 1 and ink supply cylinder 3 was first set at eight millimeters and then reduced to three millimeters. The nip width between second inking roller 2 and ink supply cylinder 3 was also first set at eight millimeters and subsequently reduced to zero. The reflection densities of the color inks remarkably decreased from their values when the nip widths had all be eight millimeters. The differences were 0.15 for yellow, 0.25 for red, 0.25 for indigo blue, and 0.30 for black.

Alternate Embodiment

Figure 7:
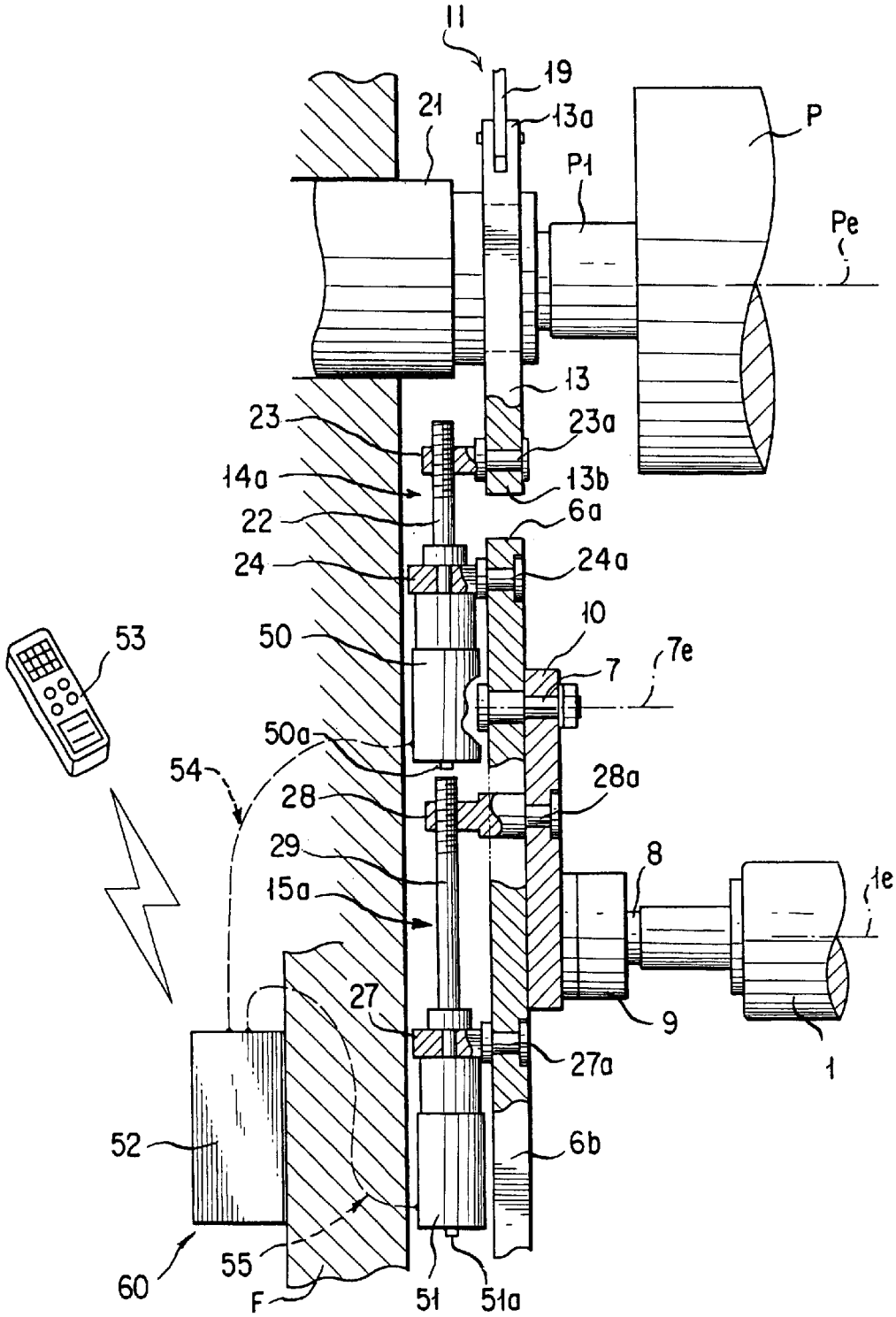
FIG. 7 is a view similar to FIG. 5 but showing an alternate embodiment of the invention.

In FIG. 7 is shown an alternate embodiment of the invention which incorporates first power-driven nip width adjustment means 14*a* in place of the first manual adjustment means 14, FIGS. 1, 3 and 5, for adjustment of the nip width between first inking roller 1 and plate cylinder P, and second power-driven nip width adjustment means 15*a* in place of the second manual adjustment means 15, FIGS. 1, 3 and 5, for adjustment of the nip width between first inking roller 1 and ink supply cylinder 3, the latter being not shown in FIG. 7. The first and the second power-driven adjustment means 14*a* and 15*a* differ from the manual adjustment means 14 and 15 in having bidirectional electric motors 50 and 51 for driving the adjusting screws 22 and 29, respectively. These motors 50 and 51, which will be hereinafter referred to as the nip width adjustment motors or simply as the adjustment motors, are remotely controllable by means, generally designated 60, comprising a control console 52 and a pushbutton remote control unit 53.

It is understood that the first and the second manual adjustment means 37 and 38, FIGS. 2, 4 and 6, for the adjustment of the nip widths of the second inking roller 2 with respect to the plate cylinder P and ink supply cylinder 3 are similarly modified for use with the power-driven adjustment means 14*a* and 15*a* of FIG. 7. The modified adjustment means for the second inking roller 2 are not shown as such means are considered self-evident from the showing of FIG. 7 and the subsequent description thereof.

A closer inspection of FIG. 7, in comparison with FIG. 5 in particular, will reveal that the first power-driven nip width with adjustment means 14*a* are similar in construction to the first manual adjustment means 14 of the foregoing embodiment except for the adjustment motor 50 and the remote control means 60 therefor. The adjustment motor 50 has its body coupled, via a mounting bracket 24 complete with a pivot pin 24*a*, to the lug 6*a* which, as has been set forth with reference to FIG. 5, is formed in one piece with the ring 6 around the trunnion 4 of the ink supply cylinder 3. The adjustment motor 50 together with the mounting bracket 24 is capable of angular displacement relative to the lug 6*a* via the pivot pin 24*a* in a plane at right angles with the axes Pe and 1*e* of the plate cylinder P and first inking roller 1.

Operatively mounted as above to the lug 6*a*, the adjustment motor 50 has its output shaft coupled end to end to the adjusting screw 22. This adjusting screw is threadedly engaged with a nut 23 formed in one piece with a pivot pin 23*a* which extends radially from the nut and which is rotatably coupled to the lug 13*b* of the ring 13 of the inking start/stop means 11. Thus the adjusting screw 22 is both rotatable about its own axis relative to the nut 23, for longitudinal travel relative to the same, and angularly displaceable relative to the lug 13*b* about an axis parallel to the plate cylinder axis Pe.

The second power-driven nip width adjustment means 15*a* are also similar in construction to the second manual adjustment means 15, FIG. 5, of the previous embodiment except for the second adjustment motor 51. The second adjustment motor 51 has its body coupled to the lug 6*a* via a mounting bracket 27 complete with a pivot pin 27*a*, so that the second adjustment motor is likewise pivotable relative to the lug 6*a* about the axis of the pivot pin 27*a* which is parallel to the inking roller axis 1*e*.

The second adjustment motor 51 has its output shaft coupled endwise to the adjusting screw 29, which is in threaded engagement with the nut 28. Formed in one piece with the nut 28, a pivot pin 28*a* extends radially therefrom and is rotatably coupled to the inking roller carrier 10. Thus the adjusting screw 29 is both rotatable about its own axis relative to the nut 28, for longitudinal displacement relative to the same, and pivotable relative to the inking roller carrier 10 about the axis of the pivot pin 28*a* which is parallel to the inking roller axis 1*e*. As has been stated in connection with the first embodiment of the invention, the inking roller carrier 10 is pivotally coupled at 7 to the lug 6*a* and rotatably supports the trunnion 8 of the first inking roller 1 via the eccentric bearing 9.

Preferably, and as shown in FIG. 7, the motors 50 and 51 are both double-ended, that is, have armature shaft 50*a* and 51*a* projecting from their head ends as well. These projecting shaft ends are intended to be turned by hands, for manual, in addition to power-driven, adjustment of the nip widths. The manual rotation of the motor output shafts is of course possible when the motors are unenergized. It is also preferred that the motors 50 and 51 take the form of stepper motors, complete with speed reducers, for their compactness, their ease and accuracy of control of rotational angles, and their high output torque.

The control console 52 is electrically connected to the adjustment motor 50 by way of conductors 54, and to the adjustment motor 51 by way of conductors 55. Equipped to receive signals from the remote control unit 53, the control console 52 controls the motors 51 and 52 accordingly. As desired or required, however, the control console 52 may itself be furnished with pushbutton or other manual switches for direct control of the motors 50 and 51.

This alternate embodiment of the invention is akin to the first embodiment in all the other details of construction, and so in operation, too, except that no manual effort is needed for adjustment of the nip widths, assuring greater safety for the operator. Since two identical nip width adjustments are provided as aforesaid adjacent both ends of each inking roller, the two motors of each such adjustment may be made jointly controllable by one operator, both for higher efficiency of adjustment and for greater uniformity of the nip width throughout the length of each inking roller.

Although the present invention has been shown and described hereinbefore as applied to the inking mechanism of a rotary printing press, it is understood that the invention is equally well applicable to the familiar moistening mechanism of an offset lithographic press. Further the illustrated embodiments of the invention may be various modified and altered to conform to the requirements of each specific application of the invention or to design preferences. It is therefore appropriate that the invention be construed broadly and in a manner consistent with the fair meaning or proper scope of the subjoined claims.

What is claimed is:

1. In a rotary printing press having a liquid form roller for receiving a liquid from a liquid supply cylinder and applying the liquid to a plate cylinder, the liquid form roller and the liquid supply cylinder and the plate cylinder being all rotatable about axes that are parallel to one another, the combination thereof with:

(a) a first pair of roller support members mounted one adjacent each end of the liquid supply cylinder for angular displacement relative to the same about the axis of the liquid supply cylinder;

(b) a second pair of roller support members mounted respectively to the first pair of roller support members for pivotal motion relative to the same about an axis parallel to the axis of the liquid supply cylinder, the second pair of roller support members rotatably supporting therebetween the liquid form roller for rolling contact with both the liquid supply cylinder and the plate cylinder; and (c) adjustment means acting between the first and the second pair of roller support members for adjustably causing the pivotal motion of the second pair of roller support members relative to the first pair of roller support members and hence for adjustably varying the width of a nip between the liquid supply cylinder and the liquid form roller;

(d) the liquid form roller when in rolling contact with both the liquid supply cylinder and the plate cylinder having its axis positioned so close to a plane containing both the axis of the pivotal motion of the second pair of roller support members relative to the first pair of roller support members and the axis of the plate cylinder, and the axis of the pivotal motion of the second pair of roller support members relative to the first pair of roller support members being positioned so close to a plane tangent to both the liquid supply cylinder and the liquid form roller at the nip therebetween, that the width of the nip between the liquid supply cylinder and the liquid form roller is adjustably variable by the adjustment means without substantially varying the width of the nip between the liquid form roller and the plate cylinder;

(e) whereby the rate of liquid transfer from the liquid supply cylinder to the plate cylinder is finely readjustable by the adjustment means.

2. The rotary printing press of claim 1 wherein the adjustment means comprises an adjusting screw to be turned manually for adjustment of the nip width between the liquid supply cylinder and the liquid form roller.

3. The rotary printing press of claim 1 wherein the adjustment means comprises an electric motor capable of bidirectional rotation for adjustment of the nip width between the liquid supply cylinder and the liquid form roller.

4. The rotary printing press of claim 3, further comprising means for remotely controlling the electric motor.

5. The rotary printing press of claim 1 further comprising second adjustment means for adjustably varying the width of the nip between the liquid form roller and the plate cylinder.

6. The rotary printing press of claim 5 further comprising start/stop means coupled to the second adjustment means for moving the liquid form roller into and out of rolling engagement with the plate cylinder.

7. The rotary printing press of claim 1 which includes a second liquid form roller for receiving the liquid from the liquid supply cylinder and applying the liquid to the plate cylinder, and which further comprises:

(a) a third pair of roller support members mounted one adjacent each end of the liquid supply cylinder for angular displacement relative to the same about the axis of the liquid supply cylinder;

(b) a fourth pair of roller support members mounted respectively to the third pair of roller support members for pivotal motion relative to the same about an axis parallel to the axis of the liquid supply cylinder, the fourth pair of roller support members rotatably supporting therebetween the second liquid form roller for rolling contact with both the liquid supply cylinder and the plate cylinder, and (c) second adjustment means acting between the third and the fourth pair of roller support members for adjustably causing the pivotal motion of the fourth pair of roller support members relative to the third pair of roller support members and hence for adjustably varying the width of a nip between the liquid supply cylinder and the second liquid form roller;

(d) the second liquid form roller when in rolling contact with both the liquid supply cylinder and the plate cylinder having its axis positioned so close to a plane containing both the axis of the pivotal motion of the fourth pair of roller support members relative to the third pair of roller support members and the axis of the plate cylinder, and the axis of the pivotal motion of the fourth pair of roller support members relative to the third pair of roller support members being positioned so close to a plane tangent to both the liquid supply cylinder and the second liquid form roller at the nip therebetween, that the width of the nip between the liquid supply cylinder and the second liquid form roller is adjustably variable by the second adjustment means without substantially varying the width of the nip between the second liquid form roller and the plate cylinder;

(f) whereby the rate of liquid transfer from the liquid supply cylinder to the plate cylinder is finely readjustable by the first recited and the second adjustment means.

8. The rotary printing press of claim 7 further comprising third adjustment means for adjustably varying the width of the nip between the second liquid form roller and the plate cylinder.

9. The rotary printing press of claim 7 further comprising:

(a) third adjustment means for adjustably varying the width of the nip between the first recited liquid form roller and the plate cylinder;

(b) fourth adjustment means for adjustably varying the width of the nip between the second liquid form roller and the plate cylinder; and (c) start/stop means coupled to both the third and the fourth adjustment means for jointly moving the first and the second liquid form roller into and out of rolling engagement with the plate cylinder.

* * * * *